United States Patent [19]

Merritt

[11] Patent Number: 4,600,193

[45] **Date of Patent: * Jul. 15, 1986**

[54] HOLLOW BAT

[76] Inventor: William Merritt, 350 First Ave., New York, N.Y. 10010

[ * ] Notice: The portion of the term of this patent subsequent to May 1, 2001 has been disclaimed.

[21] Appl. No.: 533,437

[22] Filed: Sep. 19, 1983

[51] Int. Cl.[4] ..... A63B 59/06

[52] U.S. Cl. ..... 273/72 A

[58] Field of Search ..... 273/72 R, 72 A, 73 H, 273/82 R, 82 A, 84, 67 R; 43/18.1; 52/727, 731, DIG. 7; 138/111, 115, 116, 172

[56] References Cited

U.S. PATENT DOCUMENTS

| | | | |
|---|---|---|---|
| 724,909 | 4/1903 | Maxwell | 138/115 |
| 726,801 | 4/1903 | Maxwell | 138/115 |
| 1,031,766 | 7/1912 | Yost | 138/115 |
| 1,257,471 | 2/1918 | Fitzjohn et al. | 273/167 H |
| 1,611,858 | 12/1926 | Middlekauf | 273/82 R |
| 1,811,419 | 6/1931 | Anderson | 273/72 R |
| 1,969,378 | 8/1934 | McKenzie | 273/82 R |
| 2,340,156 | 1/1944 | Taylor et al. | 273/72 R |
| 3,048,400 | 8/1962 | Friedman | 273/82 R |
| 3,265,401 | 8/1966 | Spier | 273/82 A |
| 3,479,030 | 11/1969 | Merola . | |
| 3,830,496 | 8/1974 | Reizer | 273/72 R |
| 3,880,423 | 4/1975 | Kreag | 273/72 R |
| 4,214,754 | 7/1980 | Zebelean | 273/167 H |
| 4,241,919 | 12/1980 | Foreman . | |
| 4,445,687 | 5/1984 | Merritt | 273/72 R |

FOREIGN PATENT DOCUMENTS

| | | | |
|---|---|---|---|
| 714964 | 8/1965 | Canada | 273/82 R |
| 22649 | 1/1948 | Finland | 273/72 R |

*Primary Examiner*—Richard C. Pinkham
*Assistant Examiner*—Matthew L. Schneider
*Attorney, Agent, or Firm*—Albert F. Kronman

[57] ABSTRACT

A hollow baseball bat having a hollow elongated ball hitting portion of a substantially triangular cross-sectional shape and a flattened curved hitting face is internally braced by elongated substantially plate-like members disposed between the hitting face portion and other interior surfaces of the ball hitting portion. Various forms of braces and attachment to the interior of the hitting portion are disclosed.

7 Claims, 6 Drawing Figures

HOLLOW BAT

BACKGROUND OF THE INVENTION

Hollow baseball bats made of aluminum, plastic and other suitable materials have been gaining in popularity. Such bats, however, are more susceptible to damage than solid bats, such as wooden bats since in order to maintain the same balance and weight as conventional bats they have been constructed with relatively thin wall sections, of the order of less than ⅛ inch. Attempts to overcome this difficulty have been made by placing a solid plug of metal, solid rubber, rigid plastic foam or similar material at the striking end of the bat or filling the bat with a gas under high pressure.

In my co-pending patent application entitled Baseball Bat Ser. No. 392,386, filed June 28, 1982, now U.S. Pat. No. 4,445,687, there is disclosed a baseball or softball bat of somewhat triangular cross section at its ball striking portion having a ball hitting surface of larger curvature than conventional bats. The large unsupported curved hitting surface of such a bat in its hollow metal embodiment presents an added opportunity for denting and metal fatigue.

Accordingly, it is an object of the present invention to provide structural improvements in hollow baseball bats and particularly bats having a somewhat trangular cross sectional shape at their hitting portion to prevent denting and metal fatigue.

Another object of the present invention is to improve the structural strength of hollow metal baseball bats without changing their acceptable weight and balance.

A further object of the present invention is to provide a bat of structural strength which is readily fabricated of metal, without recourse to dissimilar materials.

Still another object of the present invention is to provide a strengthened hollow metal bat of unitary construction.

SUMMARY OF THE INVENTION

Hollow baseball bats made in accordance with the present invention are formed with internal structures which will prevent damage to the bat during use, such as denting or metal fatigue. The disclosure is particularly directed to bats having a ball hitting portion with a somewhat triangular cross sectional shape.

In one embodiment of the invention the wall of the bat is thickened at the corners of the somewhat triangular hitting portion of the bat and an elongated brace is disposed within the said hitting portion interconnecting the wall of the ball striking portion to the apex of the angle opposite the hitting portion.

Other embodiments disclose various brace arrangements within the bat to increase its strength and ability to withstand sharp intense local impacts which might cause dents or metal fatigue.

BRIEF DESCRIPTION OF THE FIGURES

In the accompanying drawing, forming part hereof, similar elements have been given the same reference numerals, in which drawing.

DETAILED DESCRIPTION

Figure 1:
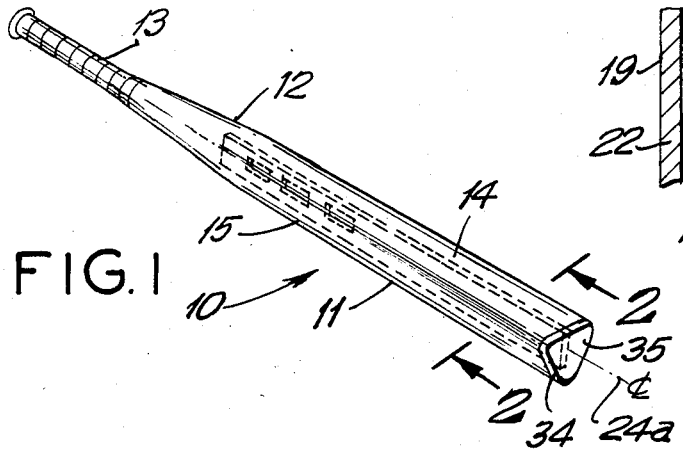
FIG. 1 is a somewhat isometric view of a baseball bat made in accordance with the present invention.
Figure 2:
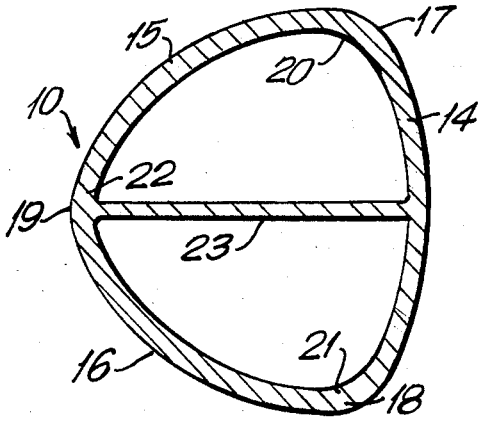
FIG. 2 is a cross sectional view taken on line 2—2 in FIG. 1, somewhat enlarged.

Referring to the drawing and specifically to FIGS. 1 and 2, there is shown a hollow bat 10 suitable for playing baseball, softball or the like made of aluminum, steel, high impact plastic or other suitable material. The bat has a ball hitting portion or head 11, an intermediate tapering portion 12 and a handle 13. A plug, cap or other closure member 35 is formed or carried at the end of the head 11.

In the illustrated bat 10, the head of the bat 11 is made with an arcuate ball hitting portion 14 and rearwardly converging slightly outwardly bowed elongated sides 15, 16. The sides are laterally disposed on the ball hitting portion 14 and converge to form a unitary somewhat triangular cross sectional hollow shape with corners 17, 18, 19 as best shown in FIGS. 1–5. The arc of the ball hitting portion 14 is flatter than that of a bat having a cylindrical cross section and consists of a segment of a circle of the order of 2½ times that of a conventional bat of equal size and weight. The additional area required for the enlarged ball hitting portion is compensated for by the converging sides 15, 16.

Since the hereindisclosed bat head 11 is preferably formed of a relatively thin gauge metal such as aluminum it is important that the bat be able to withstand the impact of hitting the ball or other customary sharp blows without denting or cracking by reason of metal fatigue. It will also be noted that the substantially triangular cross sectional shape of the bat head 11 presents large unsupported surfaces between the corners of the triangle.

When an object such as a ball, or even another bat, strikes one of the sides 15, 16 or the surface of the ball hitting portion 14 there is a tendency to buckle the struck surface of the bat rotating it about two of the corners 17, 18 or 18–19 or 19, 17. This action is hereinafter referred to as the "hinge-like movement". In addition, a localized force is imposed upon the bat head at the contact point, particularly if the object struck is small, such as a baseball, stone, etc. The effect of such local impact, particularly upon a large unsupported somewhat flat surface is to create dents or dimples.

In order to prevent the hinge-like movement due to impact upon the bat, the wall thickness of the shell has been increased at the corners 17, 18, 19 as shown in FIG. 2 as indicated at 20, 21, 22. This thickening is preferably formed as the bat shell is extruded or otherwise fabricated so that the head of the bat is a sutstantially integral member. The ball hitting portion 14 presents the largest unsupported arc in the present invention and the one most subject to severe impacts. For this reason, an elongated wall-like brace 23 is disposed within the bat shell between the vertical center line **24*a* of the arc of surface 14 and the corner 19 where sides 15, 16** meet.

Figure 4:
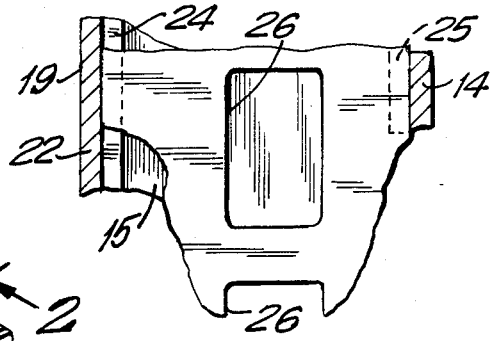
FIG. 4 is a fragmentary view in side elevation of an internal supporting wall useful in the present invention.
Figure 3:
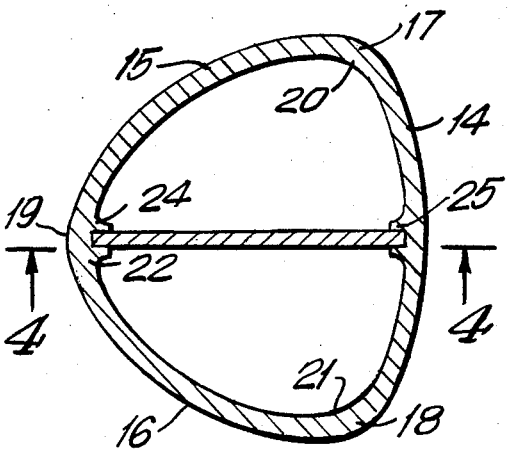
FIG. 3 is a view similar to FIG. 2 showing another embodiment of the present invention.

The brace 23 can be made of any suitable metal such as the metal of the shell, in which case it may be extruded or formed at the same time as the shell, or inserted through the end 34 of the bat 10 before the end of the bat is closed. If the brace 23 is to be inserted after the shell of the head is formed guides 24, 25 may be provided to receive it as shown in FIG. 3. For weight considerations, lightening openings 26 may be provided in the brace 23 as shown in FIG. 4.

In addition to the direct support that the brace 23 gives the arcuate ball hitting portion, thereby preventing hinging, the brace also shortens the unsupported dimension of the ball contacting surface to reduce the possibility of denting and metal fatigue.

Figure 5:
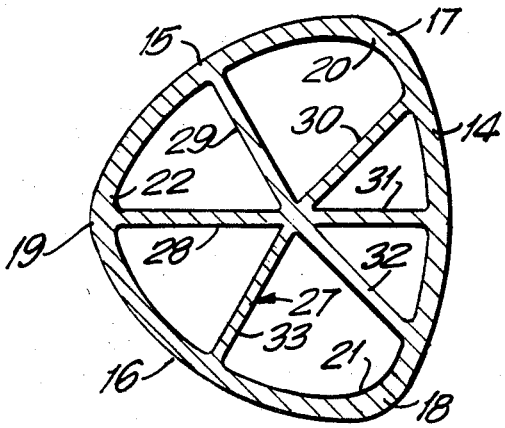
FIGS. 5 and 6 are views similar to FIG. 2 showing further embodiments of the present invention.

Referring to FIG. 5 there is shown another embodiment of the present invention in which the brace is in the nature of an elongated spider 27 coextensive with the bat head 11, having arms 28,29,30,31,32,33. The spider 27 is secured within the hollow head 11 of the bat. The spider performs all of the functions of the brace in FIGS. 2 and 3 while also supporting and stiffening the sides 15, 16 of the bat. Here again, the spider may be extruded or formed as a unitary portion of the bat shell or inserted as a separate piece as described above in connection with FIG. 3.

Figure 6:
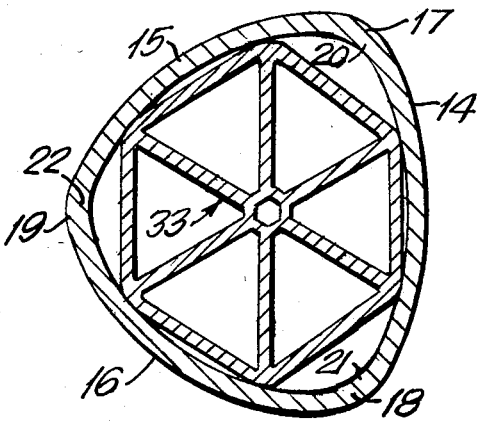

Another embodiment of the present invention, shown in FIG. 6, employs a spider 33 in the nature of a geodesic support so that an impact at any portion of the bat will be distributed to other portions of the bat, thereby preventing the entire force of the blow from damaging one area.

Having thus fully described the invention what is desired to be claimed by Letters Patent is:

1. A baseball bat comprising a hollow, unitary elongated head of substantially triangular cross-sectional shape, an elongated handle and an elongated intermediate portion interconnecting the head and the handle, said head having an elongated, arcuate, ball hitting portion, two elongated somewhat arcuate side members laterally disposed on each side of the ball hitting portion and converging to form a corner of the triangular cross-sectional shape opposite the said hitting portion, and elongated brace means internally carried by the head between the ends of the arc of the ball hitting portion and structurally secured to at least one of the elongated side members to divide the unsupported portion of the ball contacting surface into at least two segments and distribute the impact of a force applied to the said large ball contacting surface directly to at least one of the side members of the bat.

2. A bat according to claim 1 in which the hollow head is closed at its end opposite the handle, and the brace means is carried midway between the ends of the ball hitting portion.

3. A bat according to claim 1 in which the brace means is an elongated internal wall interconnecting the arcuate ball hitting portion and the corner of the bat opposite said hitting portion.

4. A bat according to claim 3 in which the internal wall is integral with the material of the hollow head.

5. A bat according to claim 3 in which the inner surface of the wall of the arcuate ball hitting portion and the corner of the bat opposite said hitting portion are provided with guides to receive the internal wall.

6. A bat according to claim 1 in which the brace means is an elongated spider having outwardly extending arms internally supporting the ball hitting portion and the said walls.

7. A bat according to claim 6 in which the spider is in the form of geodesic structure.

* * * * *